US012589922B2

(12) United States Patent
Fracasso et al.

(10) Patent No.: US 12,589,922 B2
(45) Date of Patent: Mar. 31, 2026

(54) CLOSING DEVICE FOR CONTAINERS AND ASSEMBLY COMPRISING A CONTAINER PROVIDED WITH SAID CLOSING DEVICE

(71) Applicant: GIFLOR S.R.L., Grumolo delle Abbadesse (IT)

(72) Inventors: Mattia Fracasso, Caldogno (IT); Paolo Lobba, Marostica (IT)

(73) Assignee: GIFLOR S.R.L., Grumolo Delle Abbadesse (IT)

( * ) Notice: Subject to any disclaimer, the term of this patent is extended or adjusted under 35 U.S.C. 154(b) by 13 days.

(21) Appl. No.: 18/289,134

(22) PCT Filed: May 2, 2022

(86) PCT No.: PCT/IB2022/054021
§ 371 (c)(1),
(2) Date: Nov. 1, 2023

(87) PCT Pub. No.: WO2022/238809
PCT Pub. Date: Nov. 17, 2022

(65) Prior Publication Data

US 2024/0228131 A1 Jul. 11, 2024

(30) Foreign Application Priority Data

May 13, 2021 (IT) ..... 102021000012413

(51) Int. Cl.
*B65D 47/08* (2006.01)
*B65D 41/04* (2006.01)
(Continued)

(52) U.S. Cl.
CPC ..... *B65D 47/0804* (2013.01); *B65D 41/04* (2013.01); *B65D 51/18* (2013.01);
(Continued)

(58) Field of Classification Search
CPC .... B65D 47/0804; B65D 41/04; B65D 51/18; B65D 51/242; B65D 2251/0025; B65D 2251/0078
See application file for complete search history.

(56) References Cited

U.S. PATENT DOCUMENTS 4,127,221 A * 11/1978 Vere ..... B65D 55/02 215/214
5,356,017 A * 10/1994 Rohr ..... B65D 50/045 215/245

(Continued)

FOREIGN PATENT DOCUMENTS

| | | | |
|---|---|---|---|
| CN | 101977823 | A | 2/2011 |
| CN | 112244166 | A | 1/2021 |
| DE | 297 13 186 | U1 | 12/1998 |

*Primary Examiner* — James N Smalley
(74) *Attorney, Agent, or Firm* — Birch, Stewart, Kolasch & Birch, LLP

(57) ABSTRACT

The present invention refers to a closing device for a container, including a main body suited to be connected to the container and a lid hinged to the main body at the level of a hinge area. The lid includes an inner face facing towards the main body and an outer face opposite the inner face. The main body and the cover are made so that they are integral with each other and a through opening is made between the outer face and the inner face of the lid.

18 Claims, 16 Drawing Sheets

(51) Int. Cl.
*B65D 51/18* (2006.01)
*B65D 51/24* (2006.01)

(52) U.S. Cl.
CPC .... *B65D 51/242* (2013.01); *B65D 2251/0025* (2013.01); *B65D 2251/0078* (2013.01)

(56) References Cited

U.S. PATENT DOCUMENTS

| | | | | |
|---|---|---|---|---|
| 5,547,109 | A * | 8/1996 | Robbins, III | B65D 83/06 222/456 |
| 7,163,127 | B2 * | 1/2007 | Seelhofer | B65D 47/0804 222/83 |
| 2006/0273062 | A1 * | 12/2006 | Delage | B65D 47/0814 220/254.5 |
| 2014/0284347 | A1 | 9/2014 | Fracasso | |

* cited by examiner

CLOSING DEVICE FOR CONTAINERS AND ASSEMBLY COMPRISING A CONTAINER PROVIDED WITH SAID CLOSING DEVICE

CROSS REFERENCE TO RELATED APPLICATIONS

This application is the National Phase of PCT International Application No. PCT/IB2022/054021, filed on May 2, 2022, which claims priority under 35 U.S.C. 119(a) to patent application No. 102021000012413, filed in Italy on May 13, 2021, all of which are hereby expressly incorporated by reference into the present application.

TECHNICAL FIELD OF THE INVENTION

The present invention concerns the field of manufacture of dispensing systems comprising a container associated with a closing device.

In particular, the present invention concerns the field of manufacture of closing devices, or caps, suited to be used for closing said containers, such as bottles or tubes.

DESCRIPTION OF THE STATE OF THE ART

It is known that the dispensing systems of the prior art comprise various types of caps that are applied to bottles or tubes, such as shampoo, body wash, toothpaste containers and the like.

According to the prior art, the caps for such containers are made of plastic and consist of two parts: a main body suited to be connected to the container and a second movable part in the form of a lid. The two parts are advantageously hinged to each other, and the lid is typically rotated with respect to the main body. The two parts are preferably made integrally defining a single body, preferably obtained by means of moulding techniques.

The main body of the cap is associated with an open end area, or neck, of the container and is provided with a dispensing hole that is closed and/or opened by moving/rotating the lid.

Normally the main body of the cap is applied by pressure or by screwing it to the open end area of the container.

In the closed position, the lid faces and completely covers the upper surface of the main body.

However, the solution of the prior art has some drawbacks.

One drawback of the known technique is constituted by the amount of material used to make the two parts that comprise the cap.

This has a negative impact on the cost of the raw material used for the production of the cap and therefore on the weight and/or production costs.

The main object of the present invention is therefore to solve, or at least partially overcome, the aforementioned drawback that characterizes the solutions known in the prior art.

In particular, it is an object of the present invention to provide a cap that makes it possible to reduce the use of raw material and thus limit the weight and/or production cost of the cap itself.

Dispensing systems according to the prior art are described in DE 297 13 186 U1 and US 2014/284347 A1.

SUMMARY OF THE PRESENT INVENTION

According to a first aspect of the present invention, the subject of the same is a closing device for containers, comprising:

a main body suited to be connected to said container, said main body having an inner face suited to be arranged so that it faces towards said container when said device is connected to said container and an outer face opposite said inner face, wherein said main body comprises a through opening made between said outer face and said inner face for the passage of a product coming from said container;

a lid hinged to said main body at the level of a hinge area, said lid being suited to be arranged in a closed position and in at least one open position with respect to said main body, said lid having an inner face facing towards said main body, in said closed position, and an outer face opposite said inner face, said lid comprising means suited to close said through opening of said main body and achieve said closed position, said main body and said lid being made so that they are integral with each other;

wherein the device comprises a through opening made between said outer face and said inner face of said lid so that in said closed position of said lid with respect to said main body at least one portion of said outer face of said main body is visible.

According to a preferred embodiment of the invention, said at least one portion of said outer face of the main body and the outer face of the lid are shaped so as to form a continuous or substantially continuous surface.

By continuous or substantially continuous surface, it is preferably intended that passing from the outer face of the lid to the outer face of the main body the surface is level or, in other words, there is no unevenness.

In a preferred embodiment, said at least one portion of said outer face of said main body is defined by an area protruding from the outer face of the main body, said protruding area being suited to fit into the through opening of the lid when the lid is in said closed position with respect to the main body.

Preferably, the area protruding from the outer face of the main body and the outer face of said lid are shaped so as to form a continuous or substantially continuous surface.

By continuous or substantially continuous surface, it is preferably intended that passing from the outer face of the lid to the outer face of the main body defined by the protruding area the surface is level or, in other words, there is no unevenness.

Preferably, the thickness of the main body defined between the inner face and the outer face is constant, or substantially constant.

According to a preferred embodiment of the invention, the protruding area of the main body and the through opening of the lid have a matching shape such that the shape of the protruding area coincides with the through opening of the lid.

In a preferred embodiment, said hinge area and the through opening of the main body are positioned on opposite sides with respect to a central axis passing through the device.

Preferably, the main body is made of a transparent material.

According to a preferred embodiment of the invention, said at least one portion of the outer face of the main body is made of a transparent material.

Preferably, the main body and the lid are made in respectively different colors.

In a preferred embodiment, the closing means comprise a reference element suited to fit into the through opening of the main body.

According to a preferred embodiment of the invention, the through opening of the lid is shaped in such a way that the lid, in its open position, defines an eyelet suited to allow the device to be coupled with a coupling element.

In a preferred embodiment, the lid comprises further coupling means to allow the coupling of the device with a coupling element.

According to a preferred embodiment of the invention, the main body comprises at least one further through opening, in addition to the through opening intended for the passage of the product coming from the container, made between the outer face and the inner face of the main body.

Preferably, the closing device of the invention comprises means for connection to the container.

According to another aspect of the present invention, the subject of the same is an assembly comprising a container and a closing device associated with said container, wherein the closing device is made as described above.

In a preferred embodiment, at least one portion of a surface of the container directly faces a corresponding portion of the inner face of the lid without the interposition of the main body when the closing device is in its closed position.

BRIEF DESCRIPTION OF THE DRAWINGS

Further advantages, objects, and characteristics as well as embodiments of the present invention are defined in the claims and will be clarified below by means of the following description, in which reference is made to the attached drawings; in the drawings, the same reference numbers are used to identify corresponding or equivalent characteristics and/or component parts of the present invention. In particular, in the drawings:

DETAILED DESCRIPTION OF THE PRESENT INVENTION

Figure 2:
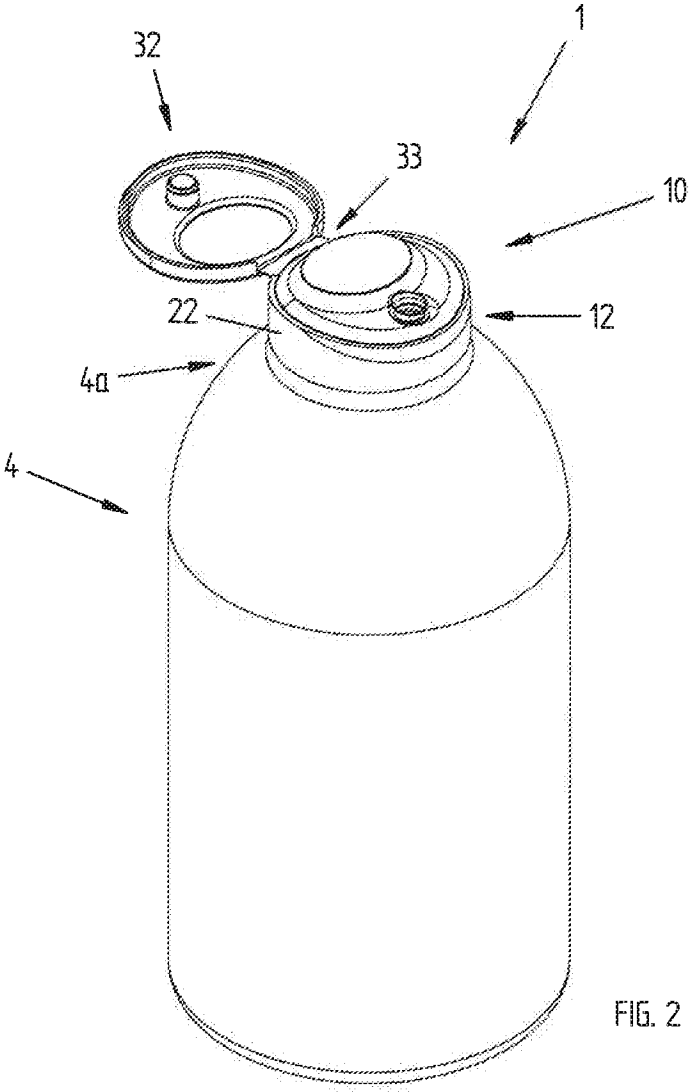
FIG. 2 shows the container of FIG. 1 with the cap in the open position.

Although the present invention is described below with reference to its embodiments shown in the drawings, the present invention is not limited to the embodiments described below and represented in the drawings.

On the contrary, the embodiments described herein and shown in the drawings clarify some aspects of the present invention, the purpose of which is defined by the claims.

The present invention has proved to be particularly advantageous when applied to closing devices for containers suitable for containing products in a fluid form such as, for example, body care products like shampoos, body washes, toothpastes, or cosmetic products like cosmetic creams and similar products.

More preferably, the present invention has proved to be particularly advantageous when applied to closing devices made of plastic and obtained by means of moulding techniques. It should be noted, however, that the present invention is not limited to such a use. On the contrary, the present invention can be conveniently used for any application requiring the use of closing devices for containers suited to contain an easily dispensable fluid product such as, for example, deodorants, depilatory creams, or containers for pharmaceutical or veterinary products, or containers for cooking products such as mayonnaise, sauces, or even containers for adhesives and the like.

A first embodiment of a closing device 10, hereinafter simply referred to also as a cap and carried out according to the present invention, is described below with reference to FIGS. from 1 to 7; in the figures, similar or equivalent characteristics and/or component parts are identified by the same reference numbers.

Figure 1:
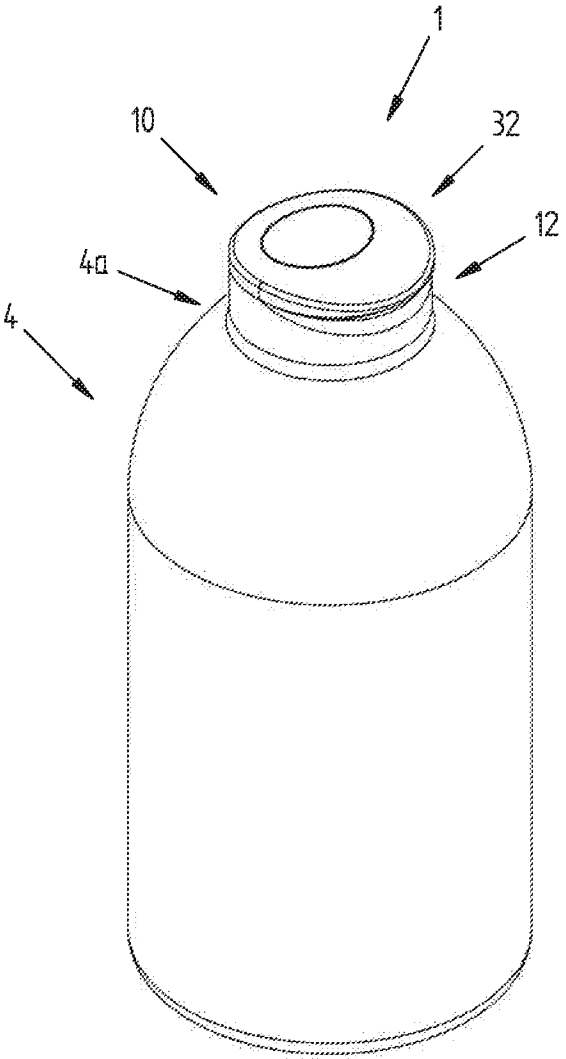
FIG. 1 shows an axonometric view of a container provided with a cap according to a first preferred embodiment of the invention.

FIG. 1 shows the closing device 10 according to the embodiment of the present invention applied to a container 4 to form an assembly 1. In this figure, the closing device 10 is in its closed configuration, that is, closed.

FIG. 2 shows the same closing device 10 applied to the container 4 in its open configuration.

The container 4 shown in the figures is a substantially cylindrical container for containing, for example, a body wash.

The container 4 is preferably made of a plastic material.

Plastics usable for this purpose preferably consist of polypropylene (PP), polyethylene (PELLD, PELD, PEMD, PEHD), and other materials known as ABL, PBL, PCR, soft touch resin.

In variant embodiments, however, the container may have another shape and/or be made of materials different from those indicated and/or described with reference to the preferred embodiments. The container may also be used for dispensing other types of products, for example preferably products in a fluid form, such as body care products like shampoos, toothpastes, or cosmetic products, such as cosmetic creams and the like.

The container 4 has a head surface 4*a*, or neck portion at the upper end, where there is an opening, not visible in the figures, for filling and dispensing the product. In the illustrated embodiment, the neck portion 4*a* preferably has a cylindrical shape. However, in variant embodiments said neck portion 4*a* may have any other shape.

The closing device 10 is advantageously applied to the container 4 through suitable connection means 20, for example by screwing, as is better described below.

However, in variant embodiments the cap may be associated with the container differently, for example through a snap connection or equivalent connection means.

For this purpose, the neck portion 4*a* of the upper end of the container 4 is provided with respective connection means suited to enable the coupling of the cap 10 and not shown in the figures.

The cap 10, clearly visible in FIGS. from 3 to 6, comprises a main body 12 and a lid 32 hinged to the main body 12.

The main body 12 can be connected to the container 4, preferably to the neck portion 4*a* of the container 4 as indicated above.

Figure 6:
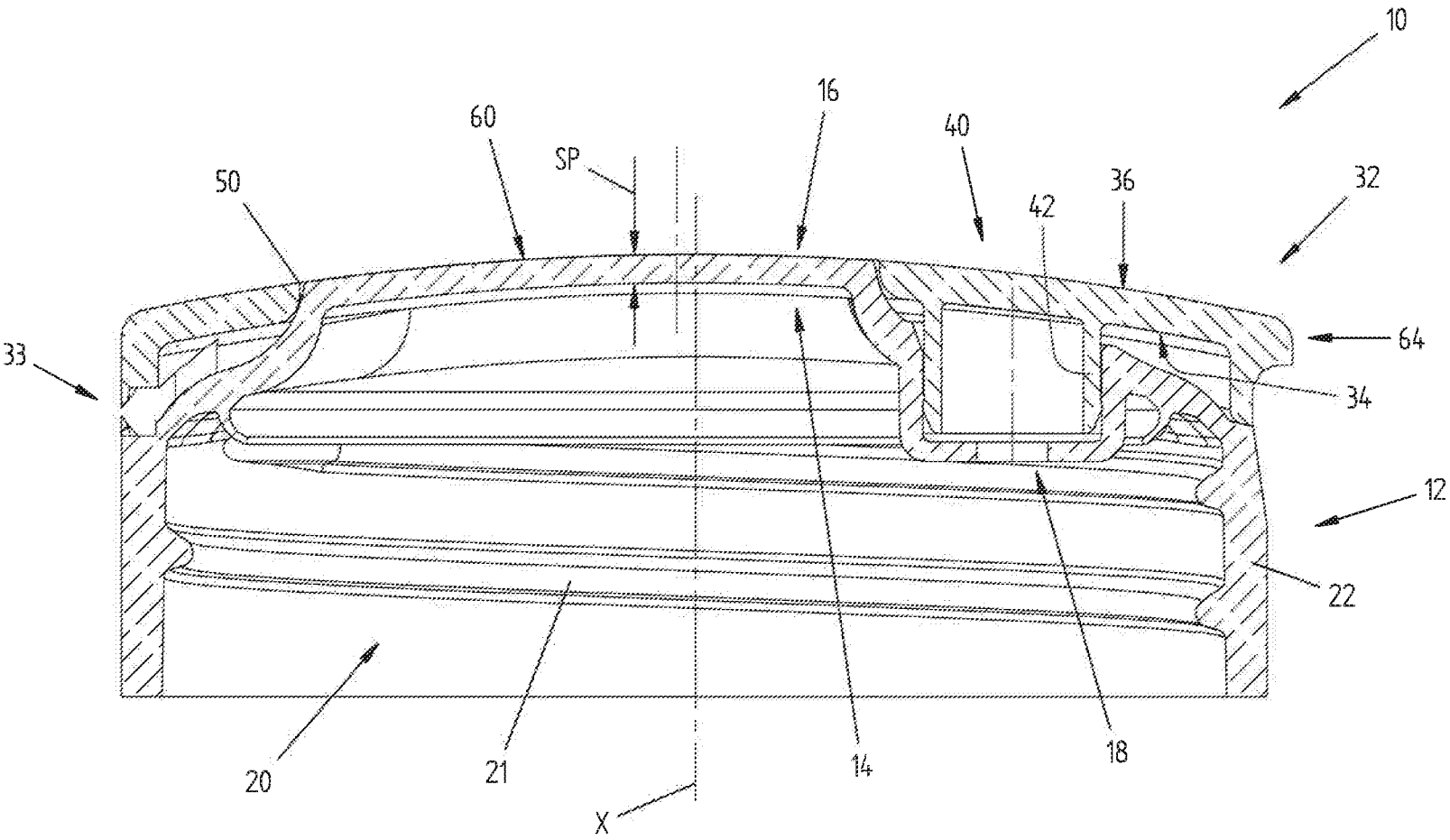
FIG. 6 shows a sectional view according to line VI-VI of FIG. 3.

The main body 12 has an inner face 14, better visible in FIG. 6, and an outer face 16 opposite the inner face 14. The inner face 14 is suited to be arranged towards the container 4 when the cap 10 is connected to the container 4.

The main body 12 preferably comprises also a through opening 18 between the outer face 16 and the inner face 14 for the passage of the product coming from the container 4.

The main body 12 is also preferably provided with connection means 20 for connection to the container, more preferably with connection means for connection to the neck portion 4*a* of the container 4.

The connection means 20 are preferably defined by a neck portion 22 of the main body 12 extending towards the container 4 from its inner face 14.

Preferably, the neck portion 22 has a cylindrical shape. However, in variant embodiments, said neck portion 22 may have different shapes.

The connection means 20 preferably allow the cap 10 to be connected to the container 4 by screwing. The connection means 20 preferably comprise a nut thread portion 21 made internally at the level of the neck portion 22. The neck portion 4*a* of the container 4 is advantageously provided with a corresponding threaded portion made on the neck portion 4*a* of the container 4.

In variant embodiments, the connection means may be of a different type, for example by providing for the creation of suitable undercut engagement areas in the neck portion of the cap and the container.

As regards the lid 32, it is hinged to the main body 12 at the level of a hinge area 33.

According to an aspect of the present invention, the main body 12 and the lid 32 are made so that they are integral with each other. Preferably, the main body 12 and the lid 32 are made so that they are integral with each other through a plastic material injection moulding process.

Plastics usable for this purpose are preferably constituted by polypropylene (PP) and/or polyethylene (PELLD, PELD, PEMD, and PEHD).

Figure 3:
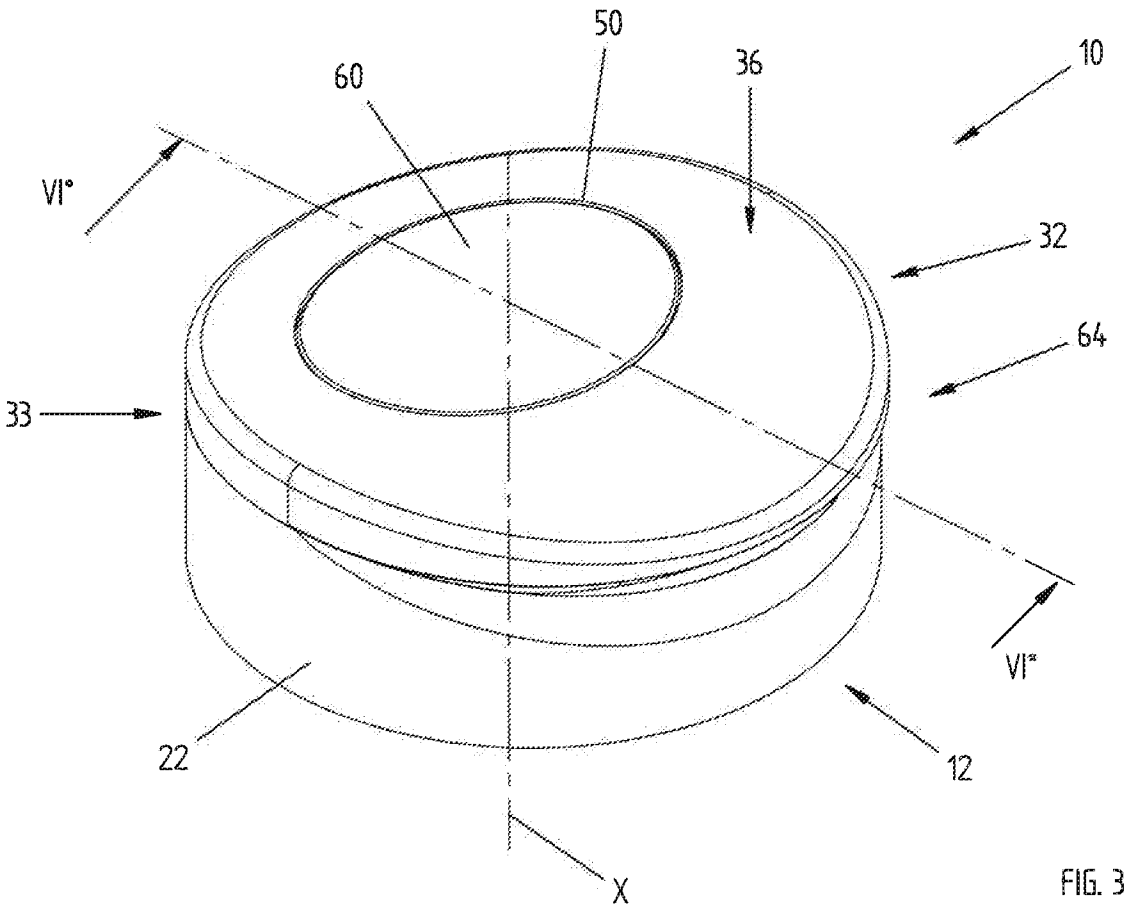
FIG. 3 shows an axonometric view of the cap of FIG. 1 in the closed position and removed from the container.
Figure 4:
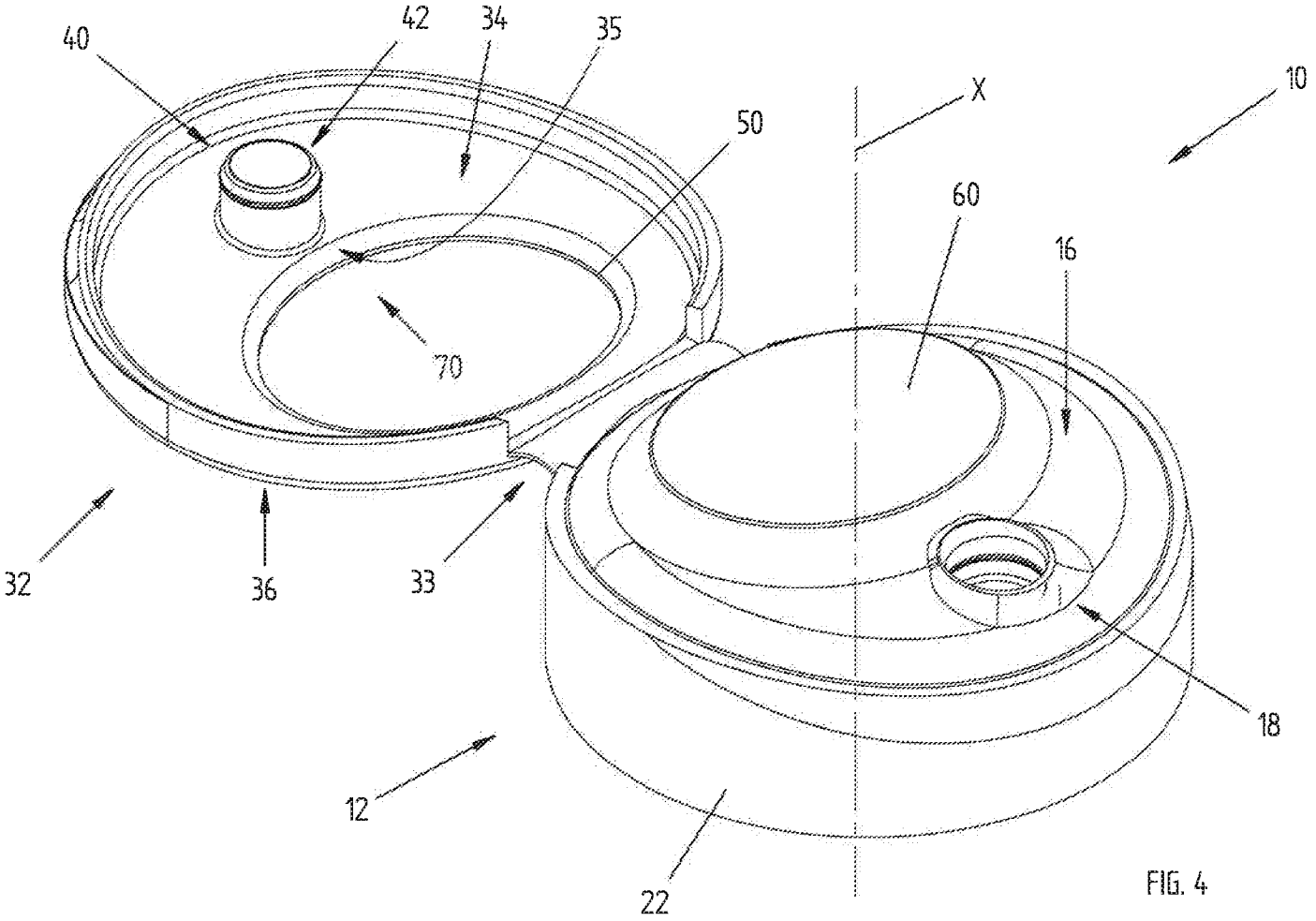
FIG. 4 shows the cap of FIG. 3 in the open position.
Figure 7:
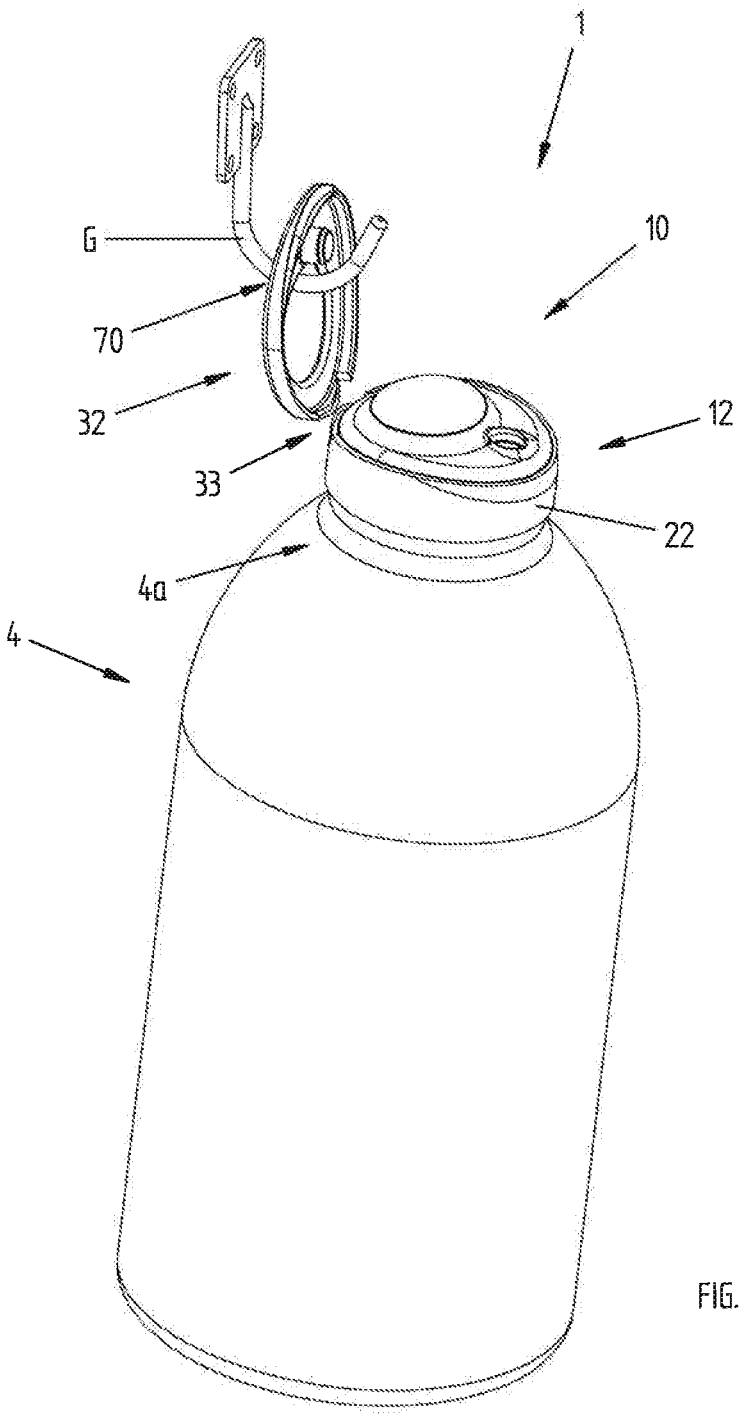
FIG. 7 shows the container with open cap of FIG. 2 in a possible preferred configuration of use.
Figure 9:
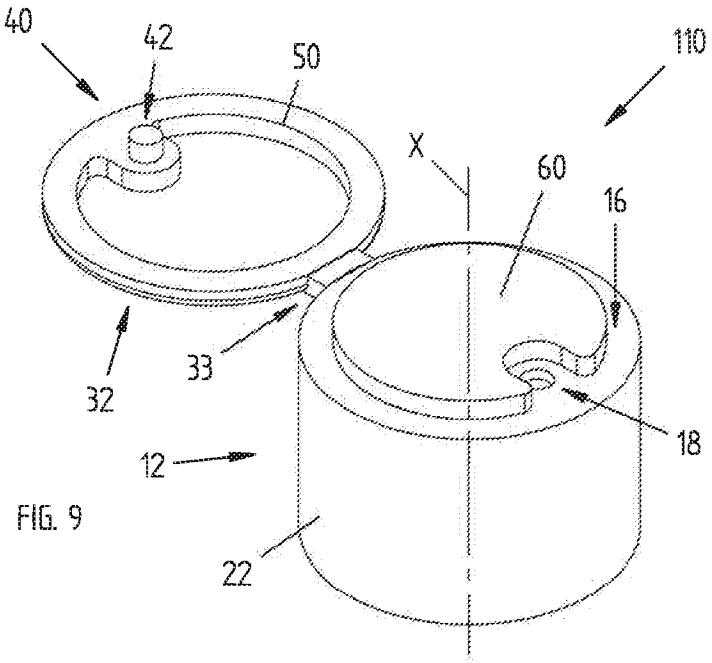
FIG. 9 shows the cap of FIG. 8 in the open position.
Figure 8:
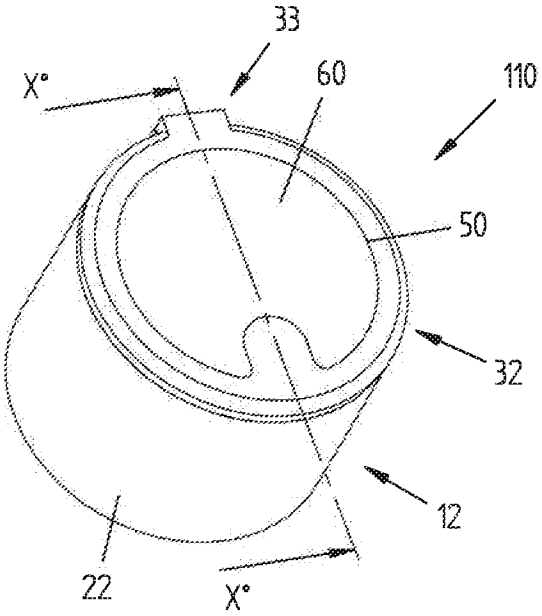
FIG. 8 shows a variant embodiment of the cap of FIG. 3.
Figure 10:
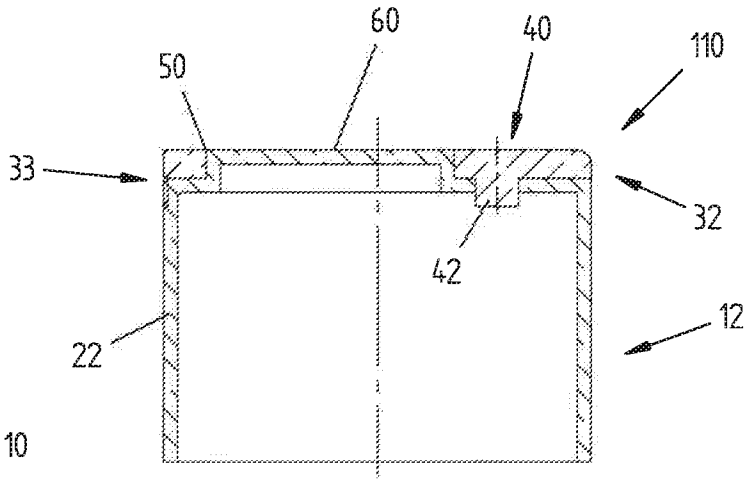
FIG. 10 shows a sectional view according to line X-X of FIG. 8.
Figure 12:
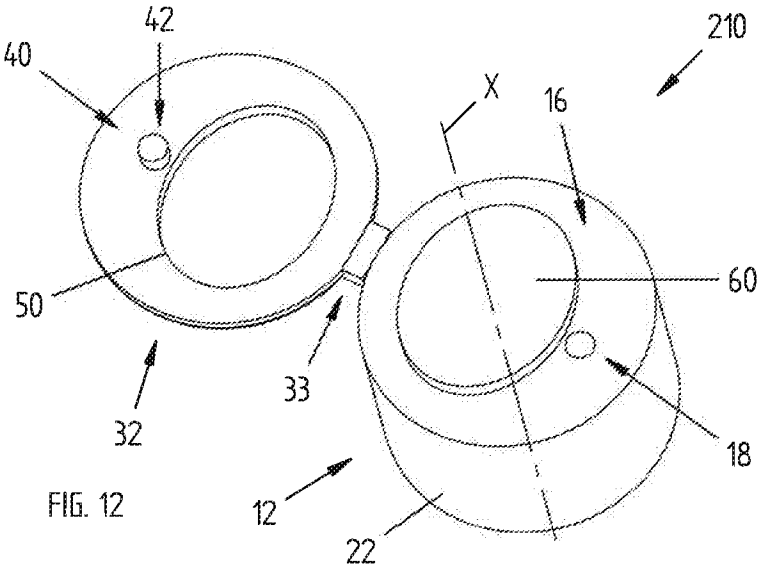
FIG. 12 shows the cap of FIG. 11 in the open position.
Figure 11:
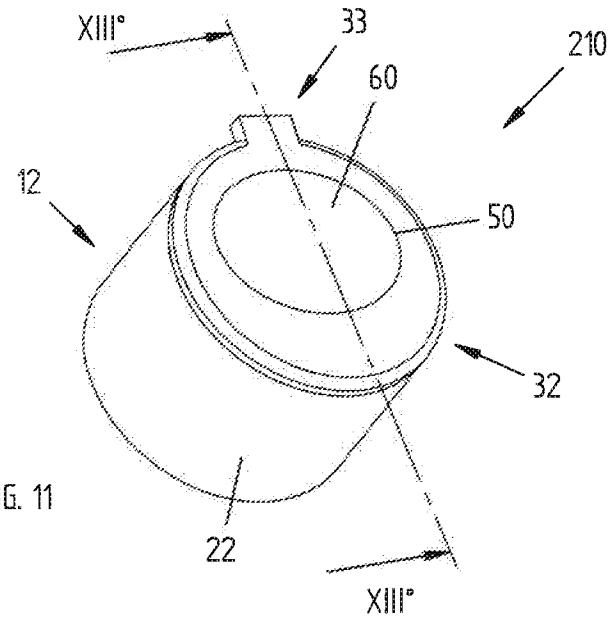
FIG. 11 shows a variant embodiment of the cap of FIG. 3.
Figure 13:
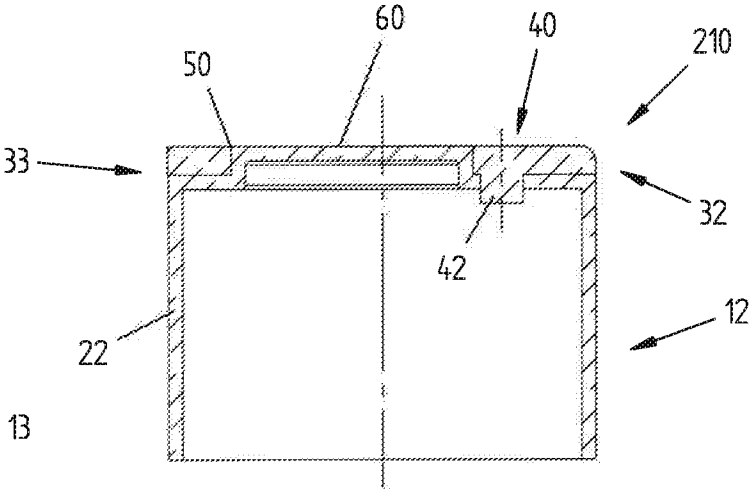
FIG. 13 shows a sectional view according to line XIII-XIII of FIG. 11.
Figure 15:
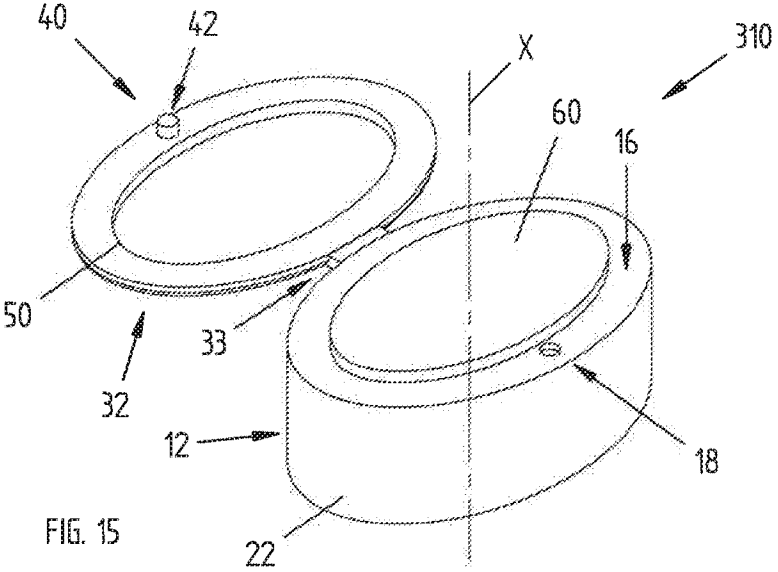
FIG. 15 shows the cap of FIG. 14 in the open position.
Figure 14:
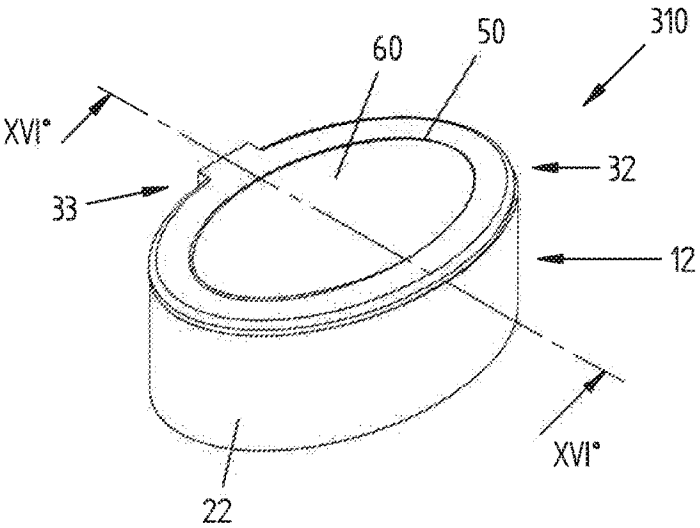
FIG. 14 shows a variant embodiment of the cap of FIG. 3.
Figure 16:
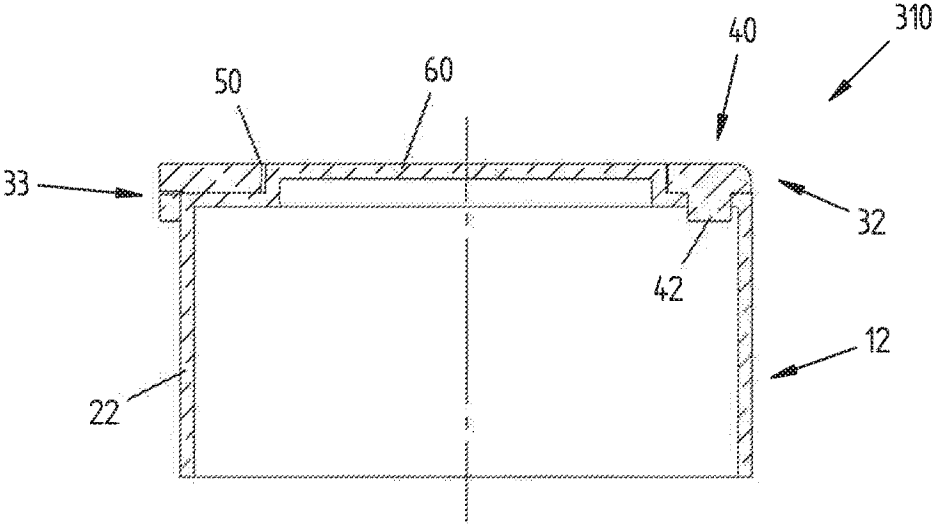
FIG. 16 shows a sectional view according to line XVI-XVI of FIG. 14.
Figure 18:
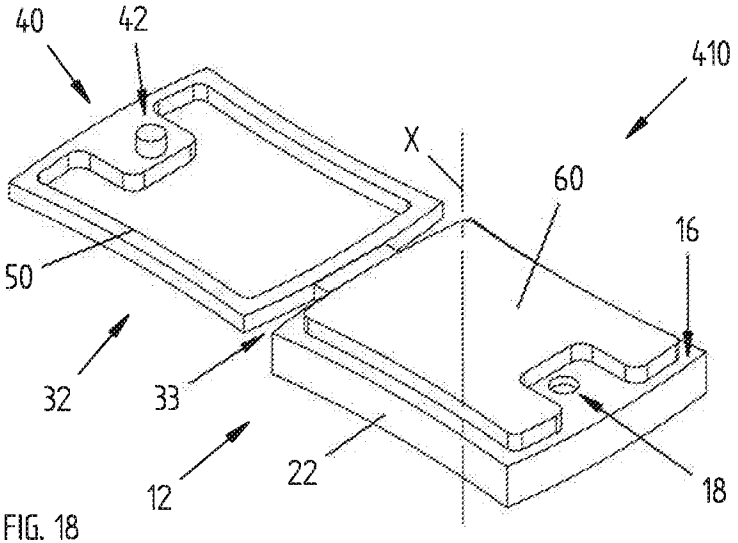
FIG. 18 shows the cap of FIG. 17 in the open position.
Figure 17:
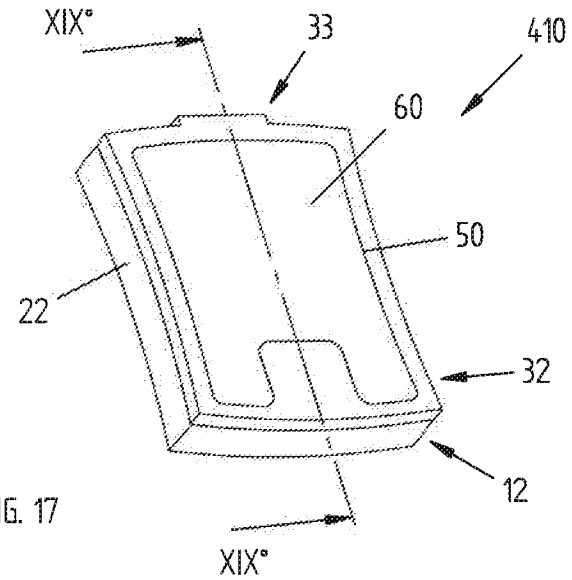
FIG. 17 shows a variant embodiment of the cap of FIG. 3.
Figure 19:
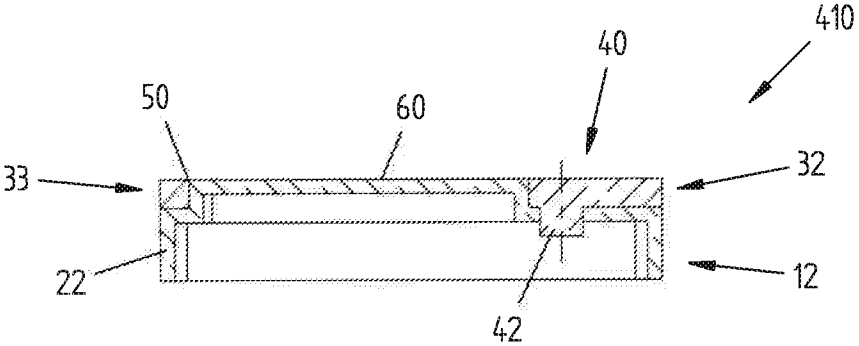
FIG. 19 shows a sectional view according to line XIX-XIX of FIG. 17.
Figure 21:
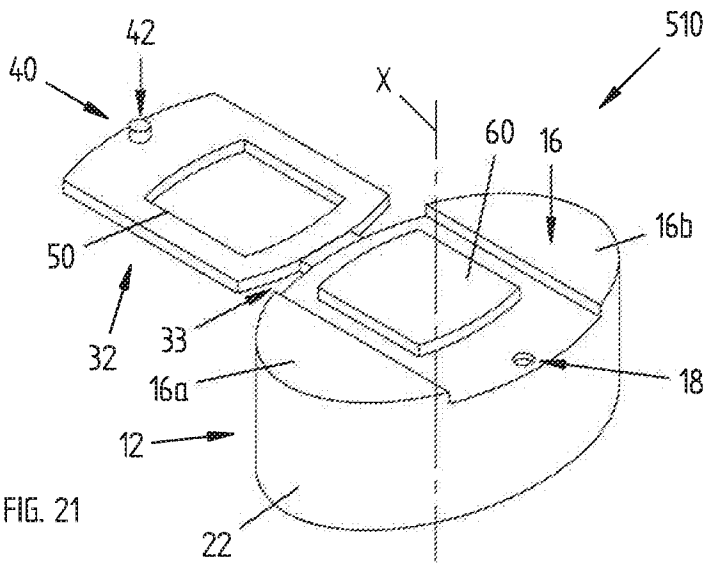
FIG. 21 shows the cap of FIG. 20 in the open position.
Figure 20:
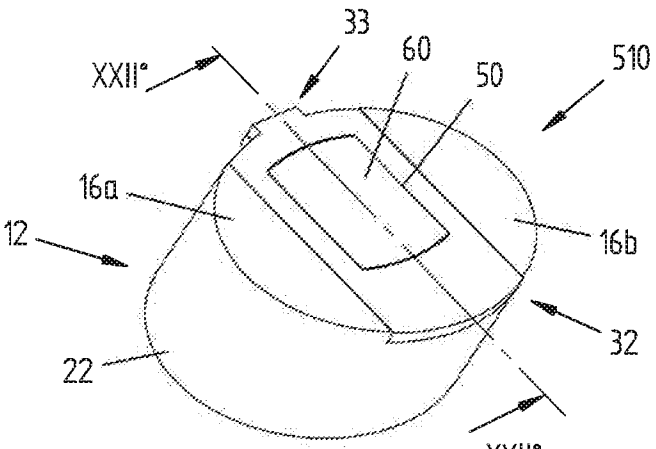
FIG. 20 shows a variant embodiment of the cap of FIG. 3.
Figure 22:
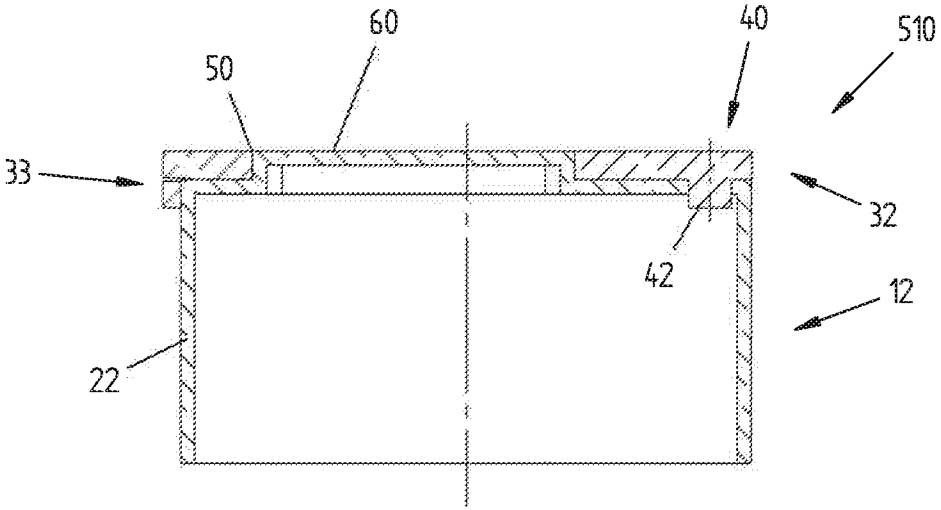
FIG. 22 shows a sectional view according to line XXII-XXII of FIG. 20.
Figure 24:
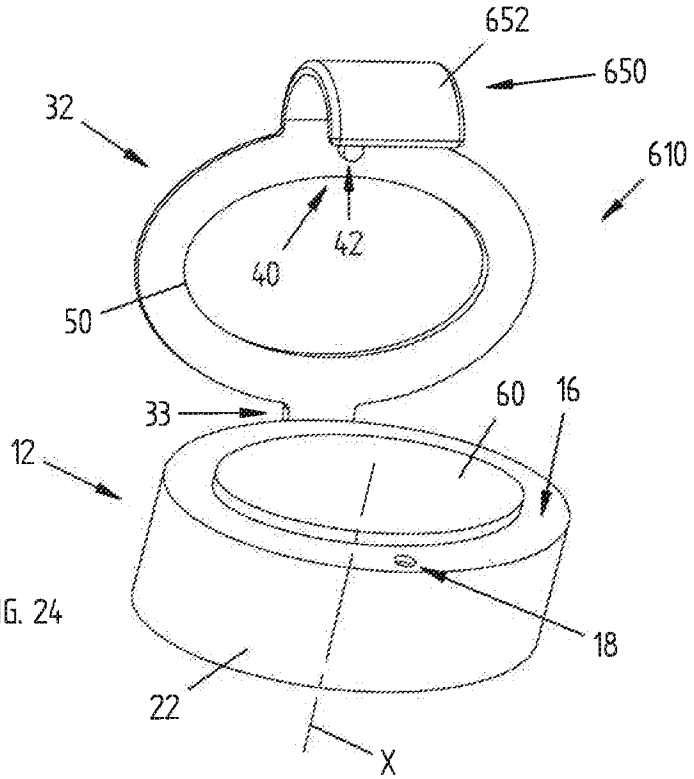
FIG. 24 shows the cap of FIG. 23 in the open position.
Figure 23:
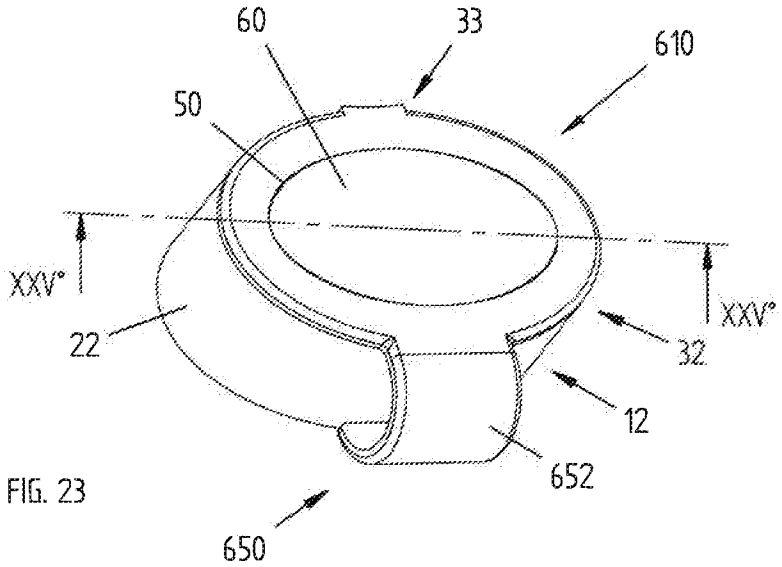
FIG. 23 shows a variant embodiment of the cap of FIG. 3.
Figure 25:
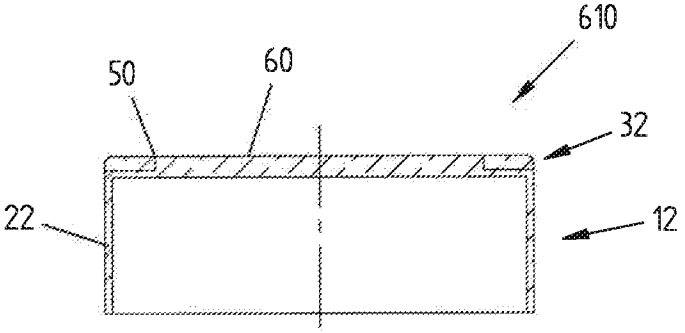
FIG. 25 shows a sectional view according to line XXV-XXV of FIG. 23.
Figure 27:
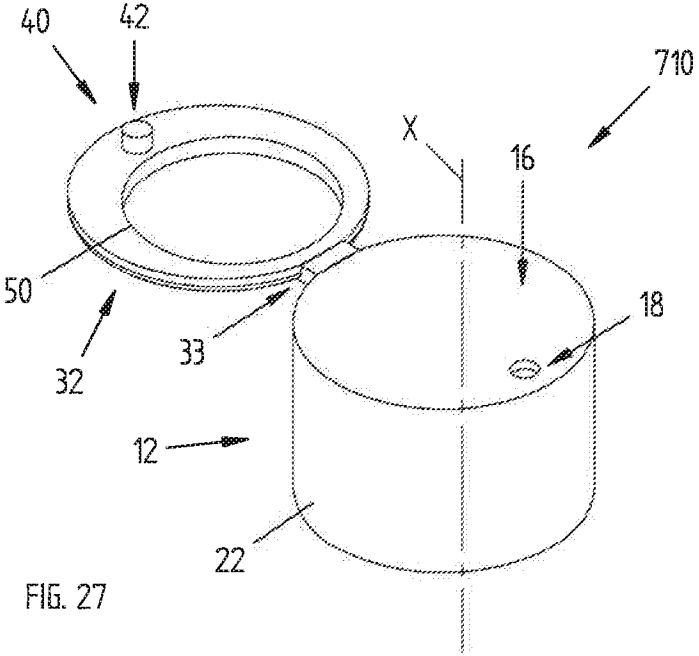
FIG. 27 shows the cap of FIG. 26 in the open position.
Figure 26:
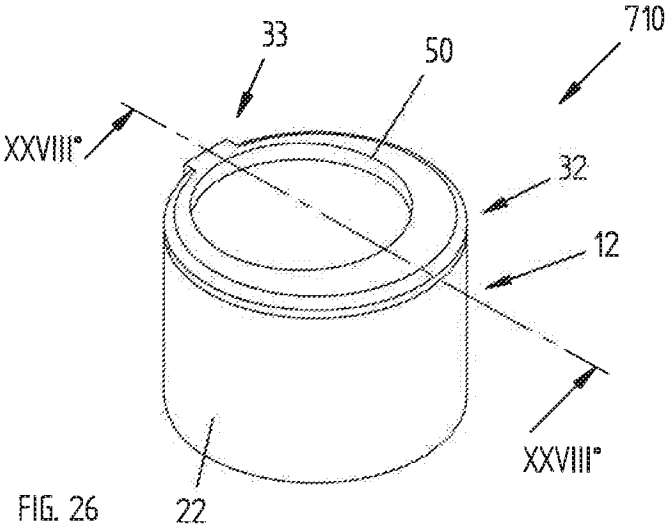
FIG. 26 shows a variant embodiment of the cap of FIG. 3.
Figure 28:
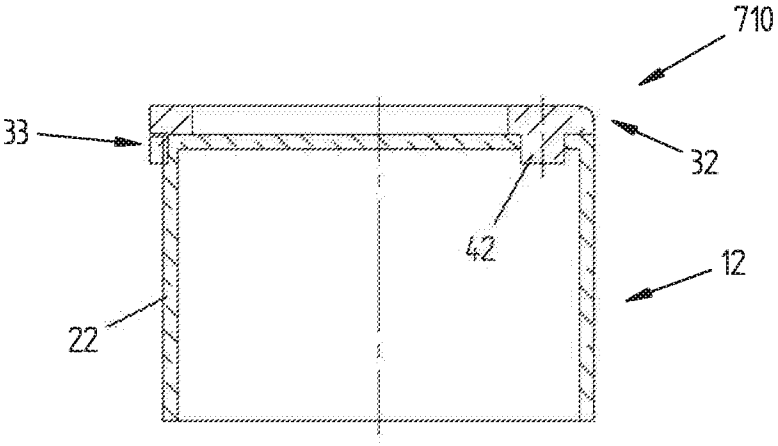
FIG. 28 shows a sectional view according to line XXVIII-XXVIII of FIG. 26.
Figure 30:
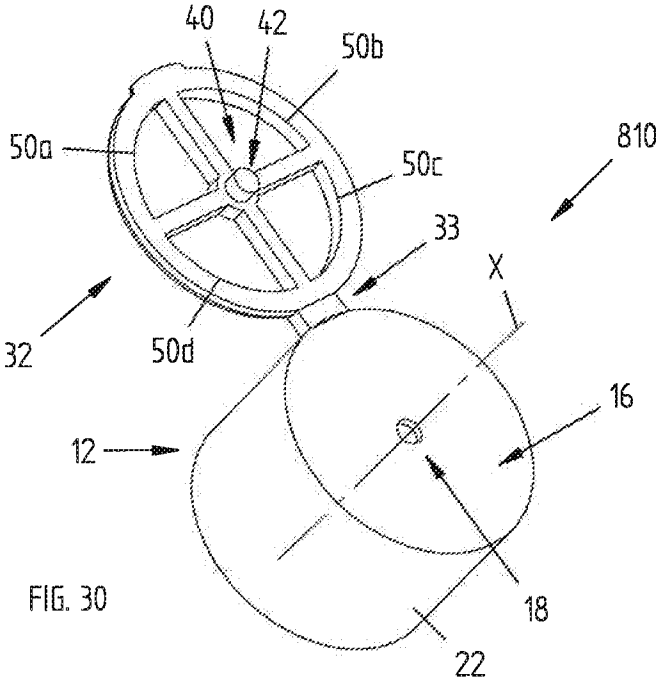
FIG. 30 shows the cap of FIG. 29 in the open position.
Figure 29:
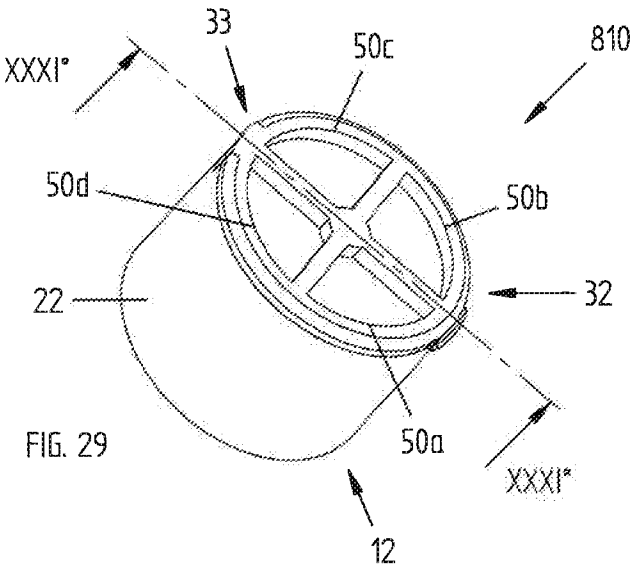
FIG. 29 shows a variant embodiment of the cap of FIG. 3.
Figure 31:
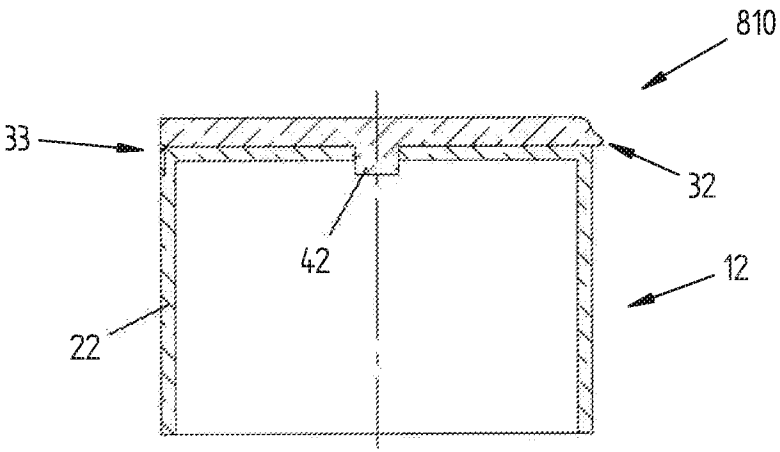
FIG. 31 shows a sectional view according to line XXXI-XXXI of FIG. 29.
Figure 33:
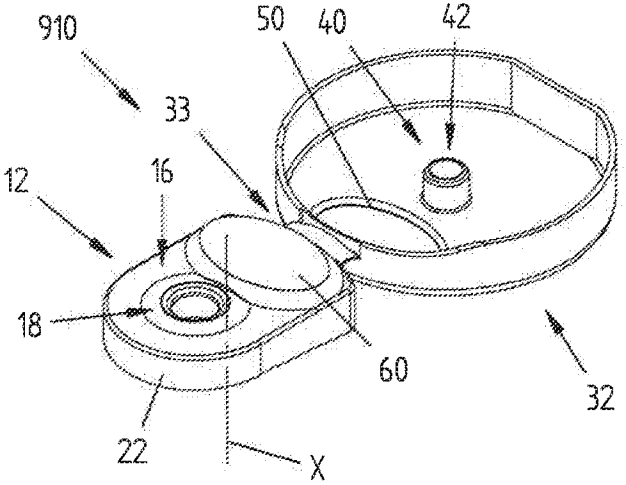
FIG. 33 shows the cap of FIG. 32 in the open position.

Thanks to this configuration of the main body 12 and the lid 32, the lid 32 can be moved, rotated in this case, in order to be arranged in a closed position, as for example shown in FIG. 1, 3 or 6, and in at least one open position with respect to said main body 12, for example as shown in FIG. 2, 4 or 7.

The lid 32 preferably comprises an inner face 34 facing towards the main body 12 and an outer face 36 opposite the inner face 34. The inner face 34 faces towards the main body 12 when the lid 32 is in its closed position.

The lid 32 preferably comprises closing means 40 suited to close the through opening 18 of the main body 12 when the main body 12 is in the closed position.

The closing means 40 preferably comprise a reference element 42 suited to intercept the through opening 18 when the main body 12 is in the closed position and preferably to be inserted into the through opening 18.

Preferably, the shape of the lid 32 substantially matches the shape of the main body 12 in such a way that, in the closed position, the lid 32 is precisely superimposed to the main body 12 and covers it completely.

According to an aspect of the present invention, the lid 32 comprises a through opening 50 made between its outer face 36 and its inner face 34.

According to an advantageous aspect of the present invention, the through opening 50 is shaped in such a way that in the closed position of the lid 32 with respect to the main body 12 at least one portion 60 of the outer face 16 of the main body 12 is visible.

Advantageously, the creation of said through opening 50 makes it possible to reduce the use of raw material for the production of the lid 32, and therefore of the cap 10, with the consequent reduction of its weight and/or production costs.

Figure 5A:
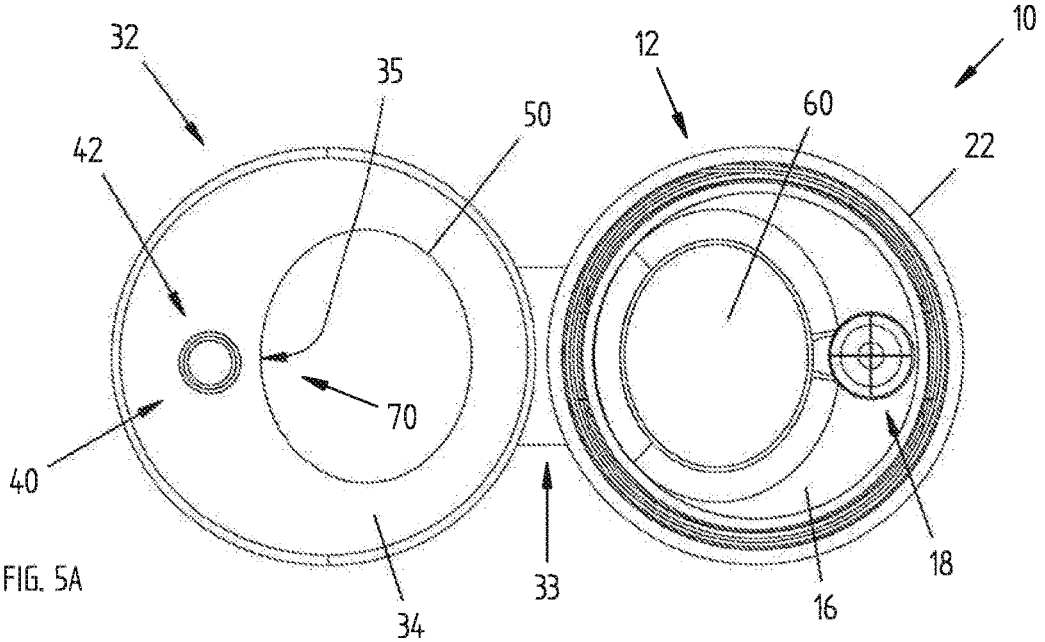
FIG. 5A shows a top plan view of FIG. 4.
Figure 5B:
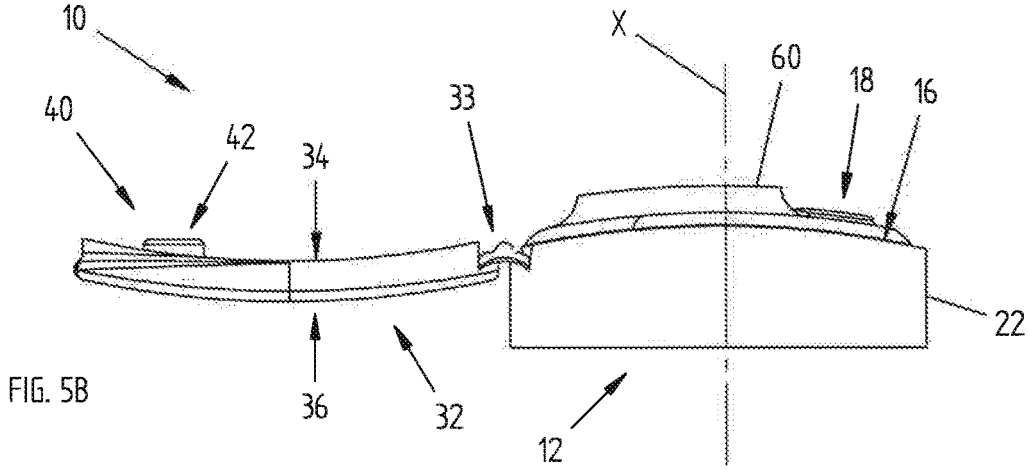
FIG. 5B shows a side plan view of FIG. 5A.

According to a preferred embodiment of the invention, as shown for example in FIGS. from 1 to 7, said at least one portion 60 of the outer face 16 of the main body 12 is defined by an area that protrudes from the same outer face 16 of the main body 12, as visible in FIGS. 4, 5B and 6. Said protruding area 60 is preferably suited to be inserted into the through opening 50 of the lid 32 when the lid 32 is in the closed position with respect to the main body 12, as shown in FIG. 3 and in the sectional view of FIG. 6.

Preferably, the protruding area 60 of the main body 12 and the through opening 50 of the lid 32 have a matching shape, in such a way that the shape of the protruding area 60 coincides, or substantially coincides, with the shape of the through opening 50 of the lid 12. According to the preferred embodiment shown in FIGS. from 1 to 7, the shape of the protruding area 60 is substantially elliptical. Clearly, in variant embodiments, some of which are also illustrated below, said shape may be different.

Advantageously, by ensuring that the protruding area 60 of the main body 12 matches, or substantially matches the through opening 50 of the lid 32, the desired stability of the lid 32 in its closed position over the main body 12 is obtained and/or maintained.

According to an advantageous aspect of the present invention, said at least one portion 60 of the outer face 16 of the main body 12 and the outer face 36 of the lid 32 are shaped in such a way as to form a continuous or substantially continuous surface. This can be appreciated in particular in FIG. 6, where it can be seen that passing from the outer face 36 of the lid 32 to the outer face 16 of the main body 12 defined by the protruding area 60 the surface is level or, in other words, there is no unevenness.

Advantageously, the creation of said continuous, or substantially continuous, surface firstly provides a unique characteristic of continuity and overall aesthetic uniformity to the cap.

Furthermore, preferably, the lack of different levels on the surface minimizes possible areas where dust/dirt could accumulate on the cap.

According to another advantageous aspect of the invention, the thickness SP of the main body 12 defined between its inner face 14 and outer face 16 remains constant, or substantially constant, throughout its length, in particular also at the level of the protruding area 60, as shown in FIG. 6. In other words, the protruding area 60 does not constitute an area of added material of the main body 12 but rather a "displacement" of material that allows the thickness of said main body 12 to be kept constant.

Furthermore, advantageously, the total thickness ST of the cap 10 intended as the thickness between the inner face 14 of the main body 12 and the outer face 36 of the lid 32 preferably has a first thickness ST1 while the total thickness ST2 of the cap 10 at the level of the through opening 50 is the same thickness SP as that of the protruding area 60.

The total thickness ST2 of the cap 10 at the level of the through opening 50 is therefore smaller than the total thickness ST1 of the cap 10 outside the through opening 50.

Advantageously, the thickness and therefore the material and/or weight of the cap according to the new solution is reduced compared to the total thickness of the caps of the known type, which is substantially constant throughout the length of the main body and the lid (given that the thickness is constituted everywhere by the sum of the thicknesses of the main body and the lid since it has no through opening).

According to another aspect of the invention, the lid 32 and the main body 12 are integral with each other, in such a way that the hinge area 33 and the through opening 18 of the main body 12 are positioned on opposite sides with respect to a central axis X passing through the cap 10. Accordingly, preferably, the hinge area 33 and the reference element 42 are also positioned on opposite sides with respect to the central axis X passing through the cap 10.

Advantageously, the gripping area 64 of the lid 32 where the lid 32 is pushed by the user to open the cap 10, which is on the opposite side with respect to the hinge area 33, is located in proximity to the through opening 18 and the reference element 42, so that during the pushing phase, when the lid 32 is pushed to open the cap 10, the mechanical deformations to which the lid 32 itself is subjected are limited as much as possible. In fact, the point of application of the opening force at the level of the gripping area 64 is close to the resistant area constituted by the reference element 42 inserted in the through opening 18 by interference.

In a preferred embodiment, at least the main body 12 is made of a transparent material. In this way, it is possible to see the inside of the container 4 through the through opening 50 of the lid 32 and the transparent portion 60, or protruding area 60, of the main body 12. The through opening 50 of the lid 32 and the transparent portion 60 define a sort of porthole that allows the contents of the container 4 to be inspected to evaluate, for example, the residual amount of product.

In a preferred variant embodiment, not all of the main body 12 is transparent but only its portion 60, or protruding area 60, in any case preferably and advantageously obtaining said porthole effect.

Moreover, in a preferred embodiment, the main body 12 and the lid 32 are made in different colours. Advantageously, it is possible to obtain an attractive aesthetic effect from the colour contrast between the colour of the main body 12 visible from the opening 50 of the lid 32 and the colour of the lid 32 itself.

According to a further advantageous aspect of the invention, the through opening 50 of the lid 32 is shaped to substantially define an eyelet in which at least one coupling area 70 is identified which is suited to enable the coupling of the cap 10, in its open position, with a coupling element G, or hook G (see FIG. 7).

Advantageously, when the cap 10 is open, the assembly 1 consisting of the container 4 and the cap 10 can be conveniently hung on the hook G simply by opening the lid 32. This operation can, for example, be particularly useful during the use of the assembly 1 when repeated dispensing of the product contained in it is expected or to facilitate the temporary positioning of the assembly 1 before it is definitively closed, for example during a shower in which the product of the assembly 1 consists of a body wash or a shampoo and the assembly can be hung on a special hook G present in the shower. The handling of the assembly 1 during its use is therefore facilitated.

Preferably, the coupling area 70 consists of at least one intermediate surface 35 joining the outer face 36 and the inner face 34 of the through opening 50 of the lid 32, as shown in FIG. 4.

Figure 5C:
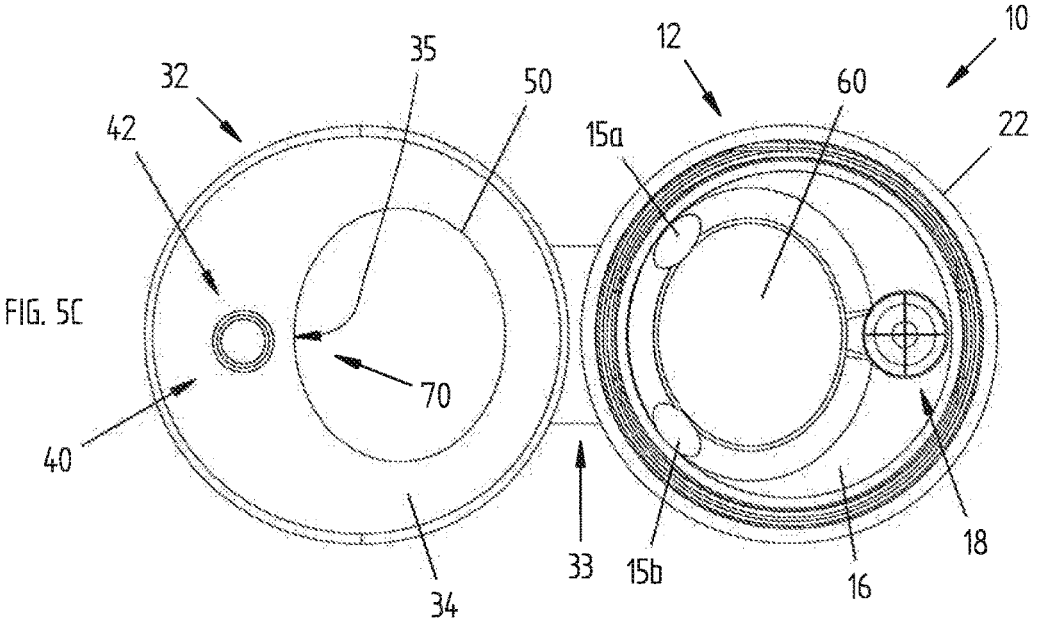
FIG. 5C shows a variant embodiment of FIG. 5A.

According to another advantageous aspect, the main body 12 comprises at least one through opening 15*a*, 15*b*, in addition to the through opening 18 intended for the passage of the product coming from the container 4, made between the outer face 16 and the inner face 14 of the main body 12, as shown in the variant embodiment of FIG. 5C.

Advantageously, the amount of material used for producing the main body 12, and therefore the material used for producing the cap 910, is reduced compared to the caps known in the art.

Said further through opening of the main body 12, as illustrated for example in FIG. 5C for the first embodiment of the cap 10, can be made in any of the embodiments illustrated and described below (an example is shown with reference to FIG. 39).

Figures from 8 to 10 show a first variant embodiment of the cap 110 of the invention.

Characteristics and/or component parts corresponding or equivalent to those of the previously described embodiment are identified by the same reference numbers, and the same is true for the different variant embodiments shown and described below, where characteristics and/or component parts corresponding or equivalent to those of the previously described embodiment are identified by the same reference numbers.

The first variant embodiment differs from the embodiment described with reference to FIGS. from 1 to 7 mainly due to the different shape and size of the through opening 50 of the lid 32 and of the corresponding protruding area 60 of the main body 12, which are substantially circular instead of elliptical.

The same applies to the second variant embodiment of the cap 210 shown in FIGS. from 11 to 13.

FIGS. from 14 to 16 show a third variant embodiment of the cap 310 of the invention.

Said variant embodiment differs from the embodiment described with reference to FIGS. from 1 to 7 due to the different shape and size of the through opening 50 of the lid 32 and of the corresponding protruding area 60 of the main body 12 as well as due to the different shape of the neck portion 22 of the main body 12, which has an elliptical rather than a cylindrical shape.

FIGS. from 17 to 19 show a fourth variant embodiment of the cap 410 of the invention.

Said variant embodiment differs from the embodiment described with reference to FIGS. from 1 to 7 due to the different shape and size of the through opening 50 of the lid 32 and of the corresponding protruding area 60 of the main body 12, which are substantially rectangular/square, as well as due to the different shape of the neck portion 22, which also has a square/rectangular shape.

FIGS. from 20 to 22 show a fifth variant embodiment of the cap 510 of the invention.

Said variant embodiment differs from the embodiment described with reference to FIGS. from 1 to 7 due to the different shape and size of the through opening 50 of the lid 32 and of the corresponding protruding area 60 of the main body 12, due to the different shape of the neck portion 22, which has an elliptical shape, as well as due to the fact that the lid 32 has a reduced size with respect to the underlying main body 12 in such a way that, in the closed position, lateral portions 16*a*, 16*b* of the outer surface 16 of the main body 12 remain visible.

FIGS. from 23 to 25 show a sixth variant embodiment of the cap 610 of the invention.

Said variant embodiment shows a further characteristic of the present invention, which is that the lid 32 is equipped with coupling means 650 to provide a further area suitable for coupling the cap 610, and the assembly comprising the container, with a possible hook G.

The coupling means 650 preferably comprise a curved surface portion 652 that extends peripherally from the lid 32.

The embodiment of the cap 610 illustrated in FIGS. from 23 to 25 substantially corresponds to the cap 310 shown in FIGS. from 14 to 16, provided with said coupling means 650. It should be noted that any of the embodiments according to the present invention may be equipped with said further coupling means 650.

Furthermore, in variant embodiments, the coupling means, which in this embodiment are constituted by the curved surface 652, may have any other shape suitable for the purpose.

FIGS. from 26 to 28 show a seventh variant embodiment of the cap 710 of the invention.

Said variant embodiment differs from the embodiment described with reference to FIGS. from 1 to 7 due to the different shape and size of the through opening 50 of the lid 32 as well as due to the fact that the upper face 16 of the main body 12 is flat, that is, without any protruding area.

FIGS. from 29 to 31 show an eighth variant embodiment of the cap 810 of the invention.

Said variant embodiment differs from the embodiment described with reference to FIGS. from 1 to 7 due to the fact that the upper face 16 of the main body 12 is flat, that is, without any protruding area, as well as due to the fact that the lid 32 has 4 openings 50*a*-50*d*, each substantially in the shape of a sector, and due to the fact that the through opening 18 of the main body 12 and the reference element 42 of the lid 32 are positioned centrally and preferably along the central axis X of the cap 810.

FIGS. from 32 to 35 show a ninth variant embodiment of the cap 910 of the invention.

Said variant embodiment differs from the embodiment described with reference to FIGS. from 1 to 7 mainly due to the fact that the size of the main body 12 is smaller than the size of the lid 32.

Advantageously, the amount of material used for producing the main body 12, and therefore the material used for producing the cap 910, is reduced compared to the caps known in the art.

In the closed position, the lid 32 is superimposed to the main body 12, completely covering it, and the lid 32 extends beyond the extension of the underlying main body 12.

Figure 35:
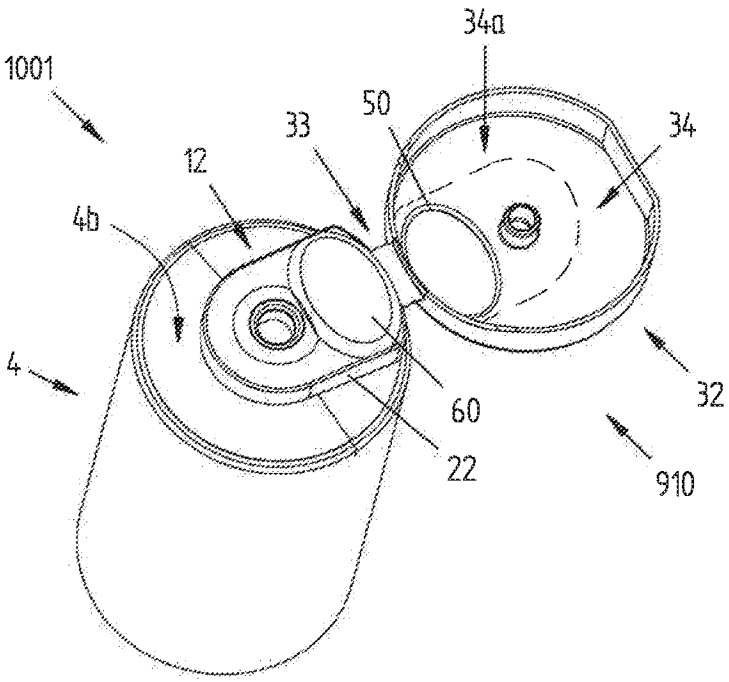
FIG. 35 shows the cap of FIG. 32 applied to a container.
Figure 32:
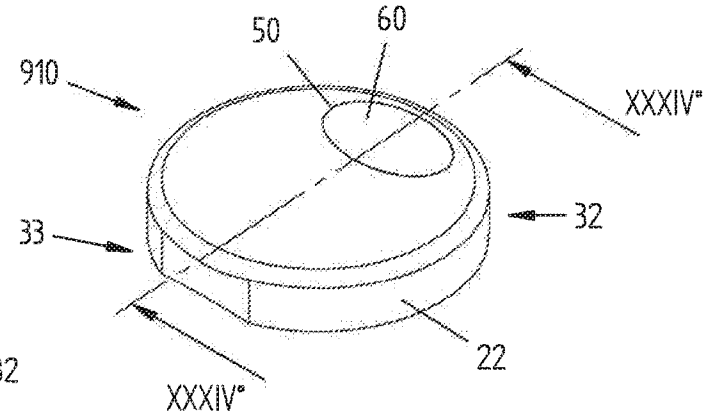
FIG. 32 shows a variant embodiment of the cap of FIG. 3.
Figure 34:
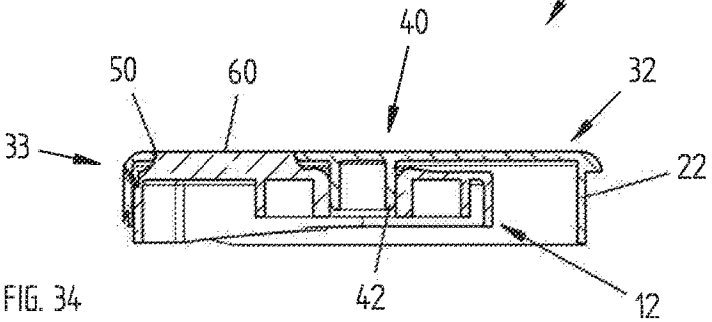
FIG. 34 shows a sectional view according to line XXXIV-XXXIV of FIG. 32.
Figure 37:
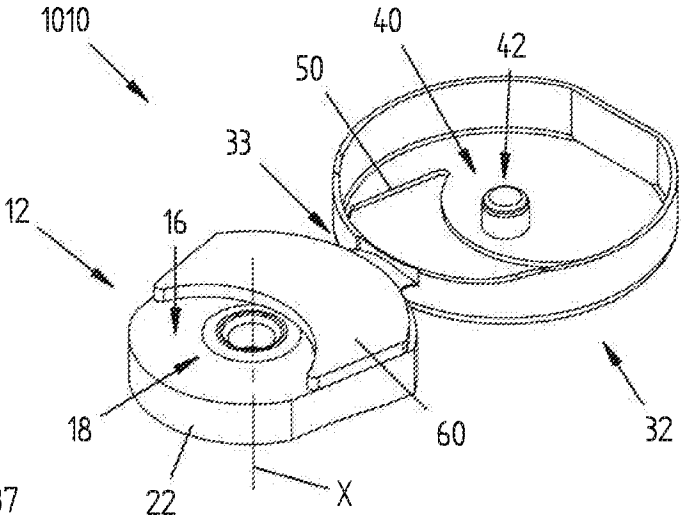
FIG. 37 shows the cap of FIG. 36 in the open position.

In addition to the above, therefore, in the closed position of the cap 910 at least one portion of the upper surface 4*b* of the container 4 directly faces a corresponding portion 34*a* of the inner face 34 of the lid 32 without the interposition of the main body 12. Said portion 34*a* is indicated in the assembly 1001 of FIG. 35 and substantially corresponds to the surface 34*a* of the inner face 34 external to the dashed area (which substantially corresponds to the outer perimeter of the main body 12).

FIGS. from 36 to 38 show a tenth variant embodiment of the cap 1010 of the invention.

Said variant embodiment differs from the embodiment described with reference to FIGS. from 32 to 35 first of all due to the different shape and size of the through opening 50 of the lid 32 and of the corresponding protruding arca 60 of the main body 12 (an annulus sector instead of an elliptical shape). The size of the main body 12 is still smaller than the size of the lid 32. Compared to the embodiment described with reference to FIGS. from 32 to 35, the difference in size between the lid 32 and the main body 12 is smaller.

Figure 39:
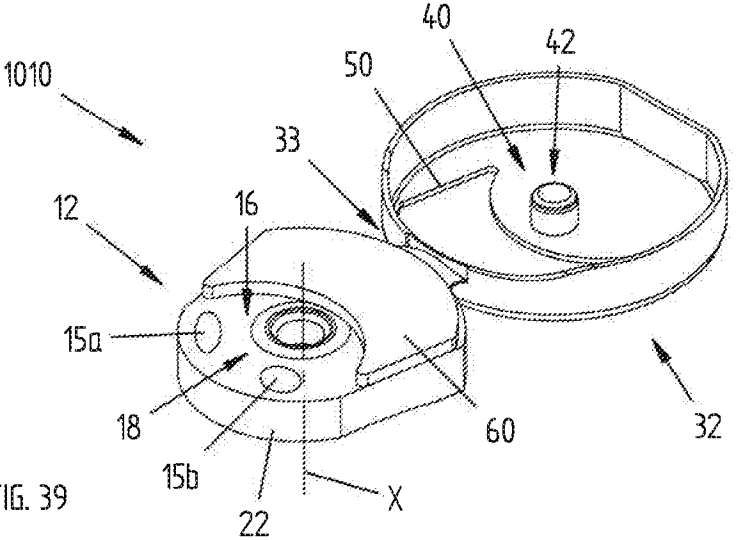
FIG. 39 shows a variant embodiment of the cap of FIG. 37.
Figure 36:
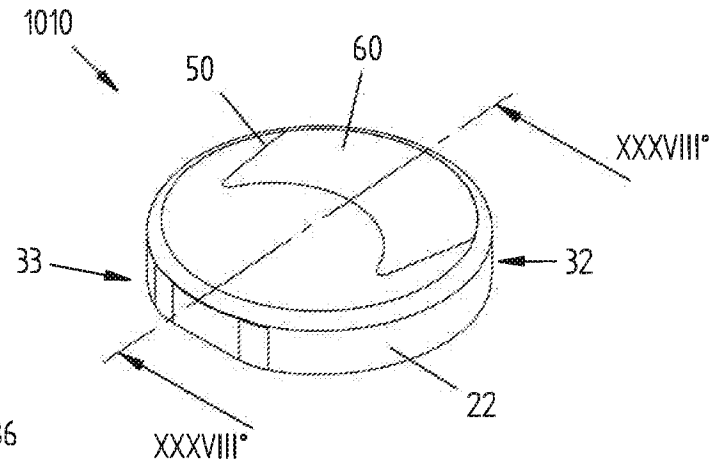
FIG. 36 shows a variant embodiment of the cap of FIG. 3.
Figure 38:
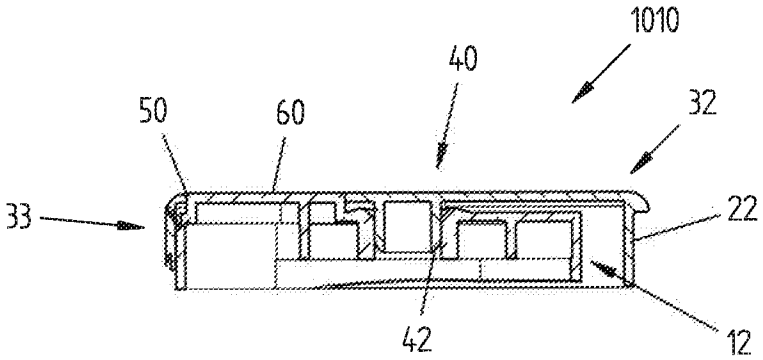
FIG. 38 shows a sectional view according to line XXXVIII-XXXVIII of FIG. 36.

FIG. 39 shows a variant embodiment of the cap 1010 of the invention described with reference to FIGS. from 36 to 38, in which the main body 12 comprises at least one through opening 15*a*, 15*b*, in addition to the through opening 18 intended for the passage of the product coming from the container 4, made between the outer face 16 and the inner face 14 of the main body 12.

Therefore, it is clear from the description provided above that the closing device that is the subject of the invention makes it possible to achieve the established objects, and in particular makes it possible to reduce the amount of material needed for its production as well as its weight and/or production costs compared to the devices known in the art.

While the present invention has been described with reference to the specific embodiments shown in the Figures, it should be noted that the present invention is not limited to the specific embodiments shown and described herein; on the contrary, further variants of the embodiments described herein fall within the scope of the present invention, which is defined by the claims.

The invention claimed is:

1. A closing device for a container, the closing device comprising:

a main body suited to be connected to said container, said main body having an inner face suited to be arranged towards said container when said device is connected to said container and an outer face opposite said inner face, wherein said main body comprises a first through opening created between said outer face and said inner face for the passage of a product coming from said container;

a lid hinged to said main body at the level of a hinge area, said lid being suited to be arranged in a closed position and in at least one open position with respect to said main body, said lid having an inner face facing towards said main body, in said closed position, and an outer face opposite said inner face, said lid comprising a closure suited to close said first through opening of said main body in said closed position, said main body and said lid being made so that they are integral with each other; and a second through opening created between said outer face and said inner face of said lid in such a way that in said closed position of said lid with respect to said main body at least one portion of said outer face integrally formed with the main body is visible so that a surface passing from the outer face of the lid to the outer face of the main body is level.

2. The closing device according to claim 1, wherein said at least one portion of said outer face of said main body and said outer face of said lid are shaped in such a way as to form a continuous or substantially continuous surface.

3. The closing device according to claim 1, wherein said at least one portion of said outer face of said main body is defined by a protruding area which protrudes from said outer face of said main body, said protruding area being suited to be inserted in said second through opening of said lid when said lid is in said closed position with respect to said main body.

4. The closing device according to claim 3, wherein said projecting area which projects from said outer face of said main body and said outer face of said lid are shaped in such a way as to form a continuous or substantially continuous surface.

5. The closing device according to claim 1, wherein the thickness of said main body defined between said inner face and said outer face is constant or substantially constant.

6. The closing device according to claim 4, wherein said projecting area of said main body and said second through opening of said lid have a matching shape, so that the shape of said projecting area coincides with the shape of said second through opening of said lid.

7. The closing device according to claim 1, wherein said hinge area and said first through opening of said main body are positioned on opposite sides with respect to a central axis passing through said device.

8. The closing device according to claim 1, wherein said main body is made of a transparent material.

9. The closing device according to claim 1, wherein said at least one portion of said outer face of said main body is made of a transparent material.

10. The closing device according to claim 1, wherein said main body and said lid are made in respectively different colors.

11. The closing device according to claim 1, wherein said closure comprise a reference element suited to intercept said first through opening of said main body.

12. The closing device according to claim 1, wherein said second through opening of said lid is shaped in such a way that said lid, in the open position, defines an eyelet suited to allow said device to be coupled with a coupling element.

13. The closing device according to claim 1, wherein said lid comprises coupling means suited to allow said device to be coupled with a coupling element.

14. The closing device according to claim 1, further comprising a connector for connection to said container.

15. An assembly comprising:

a container; and a closing device associated with said container, wherein said closing device is a closing device according to claim 1.

16. The assembly according to claim 15, wherein at least one portion of a surface of said container directly faces a corresponding portion of said inner face of said lid without the interposition of said main body when said closing device is in its closed position.

17. A closing device for a container, the closing device comprising:

a main body suited to be connected to said container, said main body having an inner face suited to be arranged towards said container when said device is connected to said container and an outer face opposite said inner face, wherein said main body comprises a first through opening created between said outer face and said inner face for the passage of a product coming from said container;

a lid hinged to said main body at the level of a hinge area, said lid being suited to be arranged in a closed position and in at least one open position with respect to said main body, said lid having an inner face facing towards said main body, in said closed position, and an outer face opposite said inner face, said lid comprising a closure suited to close said first through opening of said main body in said closed position, said main body and said lid being made so that they are integral with each other; and a second through opening created between said outer face and said inner face of said lid in such a way that in said closed position of said lid with respect to said main body at least one portion of said outer face integrally formed with the main body is visible, wherein said at least one portion of said outer face of said main body extends into and closes the second through opening in the lid.

18. A closing device for a container, the closing device comprising:

a main body suited to be connected to said container, said main body having an inner face suited to be arranged towards said container when said device is connected to said container and an outer face opposite said inner face, wherein said main body comprises a first through opening created between said outer face and said inner face for the passage of a product coming from said container;

a lid hinged to said main body at the level of a hinge area, said lid being suited to be arranged in a closed position and in at least one open position with respect to said main body, said lid having an inner face facing towards said main body, in said closed position, and an outer face opposite said inner face, said lid comprising a closure suited to close said first through opening of said main body in said closed position, said main body and said lid being made so that they are integral with each other; and a second through opening created between said outer face and said inner face of said lid in such a way that in said closed position of said lid with respect to said main body at least one portion of said outer face integrally formed with the main body is visible, wherein said at least one portion of said outer face of said main body has a same shape as the second through opening in the lid.

* * * * *